US005263607A

United States Patent [19]

Temesvary et al.

[11] Patent Number: 5,263,607

[45] Date of Patent: Nov. 23, 1993

[54] ADJUSTABLE NOZZLE FOR A DISPENSER AND METHOD OF USING SAME

[75] Inventors: Louis Temesvary, Sunnyvale; Enrique Leizgold, Danville, both of Calif.

[73] Assignee: Mölnlycke, San Ramon, Calif.

[21] Appl. No.: 928,059

[22] Filed: Aug. 11, 1992

[51] Int. Cl.[5] ..... G07F 11/16

[52] U.S. Cl. ..... 221/304; 222/567; 225/106

[58] Field of Search ..... 221/304, 303, 307, 310, 221/34, 44, 47, 55, 61, 63, 206, 207; 225/106; 222/566, 567, 568; 239/DIG. 19, 533.13, 590, 591, 602

[56] References Cited

U.S. PATENT DOCUMENTS

| | | | |
|---|---|---|---|
| 1,291,279 | 1/1919 | Unkefer | 222/566 X |
| 2,780,388 | 2/1957 | Stephenson | 221/44 |
| 2,801,133 | 7/1957 | Ridley | 239/591 |
| 2,953,285 | 9/1960 | McKelvey | 222/567 |
| 3,058,632 | 10/1962 | Stremmel | 222/567 |
| 3,112,883 | 12/1963 | Blanchard | 239/591 X |
| 3,261,558 | 7/1966 | Davies | 239/602 X |
| 3,776,470 | 12/1973 | Tsuchiya | 239/533.13 |
| 4,196,824 | 4/1980 | Labelle | 221/206 |
| 4,382,530 | 5/1983 | Calisto | 222/567 |
| 4,387,832 | 6/1983 | Margulies | 221/63 |
| 4,648,530 | 3/1987 | Granger | 221/34 |
| 4,905,868 | 3/1990 | Beane et al. | 221/44 |
| 4,915,257 | 4/1990 | Bailey | 221/34 X |
| 5,074,431 | 12/1991 | Sendelbach | 221/283 X |
| 5,104,013 | 4/1992 | Hawley | 222/566 |
| 5,141,171 | 8/1992 | Yang | 225/106 X |

FOREIGN PATENT DOCUMENTS

| | | |
|---|---|---|
| 0110473 | 6/1964 | European Pat. Off. . |
| 2359677 | 6/1975 | Fed. Rep. of Germany . |

*Primary Examiner*—Robert P. Olszewski
*Assistant Examiner*—Dean A. Reichard
*Attorney, Agent, or Firm*—Burns, Doane, Swecker & Mathis

[57] ABSTRACT

An adjustable dispenser nozzle apparatus for a paper towel container of either rolled or folded towels. The apparatus comprises a base, an adjustable fixture and an inner sleeve. The base includes a plurality of extensions separated by slits. The fixture is adjustable and as it is further threaded onto the base the extensions of the base become narrowed, resulting in a smaller exit aperture for the dispenser nozzle. Furthermore, the bottom part of the base, which is comprised of a plurality of extensions, as well as the bottom part of the inner sleeve, have sharp edges. Thus, providing a suitable surface upon which the dispensed towel may be torn.

41 Claims, 2 Drawing Sheets

ADJUSTABLE NOZZLE FOR A DISPENSER AND METHOD OF USING SAME

BACKGROUND OF THE INVENTION

1. Field of the Invention

The present invention relates to a dispenser nozzle for a paper towel container, and more particularly to a nozzle that is adjustable so as to accommodate paper towels of different thicknesses.

2. Discussion of Related Art

Paper towels have many uses and are commonly used for cleaning and drying various surfaces. Typically, the towels will come from the manufacturer in a rolled or folded configuration, with or without perforations. Whether the towels are in a perforated format or non-perforated format, the tearing of the towels is not precise, resulting in unnecessary discard of partially torn towels or the extra towels used. Thus, it has become common practice for towel dispensers to contain sharp or tensioned edges to ease the user in the tearing process.

Several towel dispensers providing structures for separating the towel from the web have been patented. For example, U.S. Pat. No. 4,905,868 to Beane et al discloses a dispenser nozzle, along with an exit aperture, for a paper towel dispenser for accurately and reliably dispensing individual towels from a continuous web of towels. The nozzle has a conical shape for passing the paper towels therethrough, and causing each paper towel to be compressed as it moves through the nozzle. As a result, the friction between the paper towel and the inside of the nozzle eventually causes the dispensed paper towel to be separated from the web of towels. Furthermore, the diameter of the exit aperture of the nozzle may be enlarged in order to accommodate thicker paper towels. To enlarge the exit aperture of the nozzle, an operator removes the tip of the nozzle by cutting, clipping or breaking. Once the operator enlarges the exit aperture, the same nozzle cannot be narrowed to accommodate a thinner towel. Thus, to narrow the exit aperture of the nozzle, the operator must replace the old nozzle portion with a new nozzle portion.

Other examples of patented towel dispensers include: U.S. Pat. No. 4,648,530 to Granger disclosing a dispenser for perforated precut folded or rolled towels and, U.S. Pat. No. 4,387,832 to Marguilles disclosing a dispenser for pre-moistened perforated towels.

While each of the above described towel dispensers function adequately, they each have drawbacks. The major drawback is that the dispenser requires that the towels be perforated, thus providing an additional cost due to the manufacturing of the towel. Furthermore, the Beane et al nozzle, while not requiring the extra cost of perforated towels, achieves an extra expense in necessitating a replacement nozzle to accommodate a thinner towel.

Therefore, what is desirable is a dispenser with a nozzle having a durable exterior capable of tearing towels, to be fitted to a paper towel container for accurately dispensing paper towels without unnecessary discarding, wherein the exit aperture of the nozzle is adjustable according to the thickness of the towel.

SUMMARY OF THE INVENTION

It is therefore an object of the present invention to provide a dispenser nozzle for accurately and reliably dispensing a continuous web of towels.

Additionally, it is a further object of the invention to provide an adjustable nozzle which can be fitted to accommodate the thickness of the towel.

Furthermore, it is a further object of the invention to provide an adjustable nozzle which can be adjusted to enlarge or decrease the size of the exit aperture for dispensing the towel.

In accordance with the invention, a nozzle for a towel dispenser includes a base, which is attachable to the towel dispenser, and a fixture which is adjustably mounted to an outer surface of the base. The base includes a channel, which is concentric with the fixture, through which the towels pass as they are dispensed. In addition, the channel forms an exit aperture at its open end, which is adjustable in size. The size of the exit aperture is determined by a position of the fixture with respect to the exit aperture.

BRIEF DESCRIPTION OF THE DRAWINGS

The present invention will now be described in detail with reference to the attached drawings, in which.

DETAILED DESCRIPTION OF THE PREFERRED EMBODIMENTS

Paper towels are dispensed from a number of different types of containers. Some containers are designed for dispensing precut or z-folded towels. Other containers are designed for dispensing towels, wherein the dispensed towels are pulled from either the inside or outside of a roll.

Although the disclosed invention may have broad applicability, it relates primarily to a nozzle for a dispenser adapted to dispense towels from the inside of a continuous roll. The dispenser may include a box-like structure, comprised of either metal or a plastic material, having an aperture in the center of the bottom thereof. A nozzle is fitted within the aperture in order to facilitate separating the towel from the web of towels in the dispenser, and furthermore to facilitate removal of the towels from the dispenser.

Figure 1:
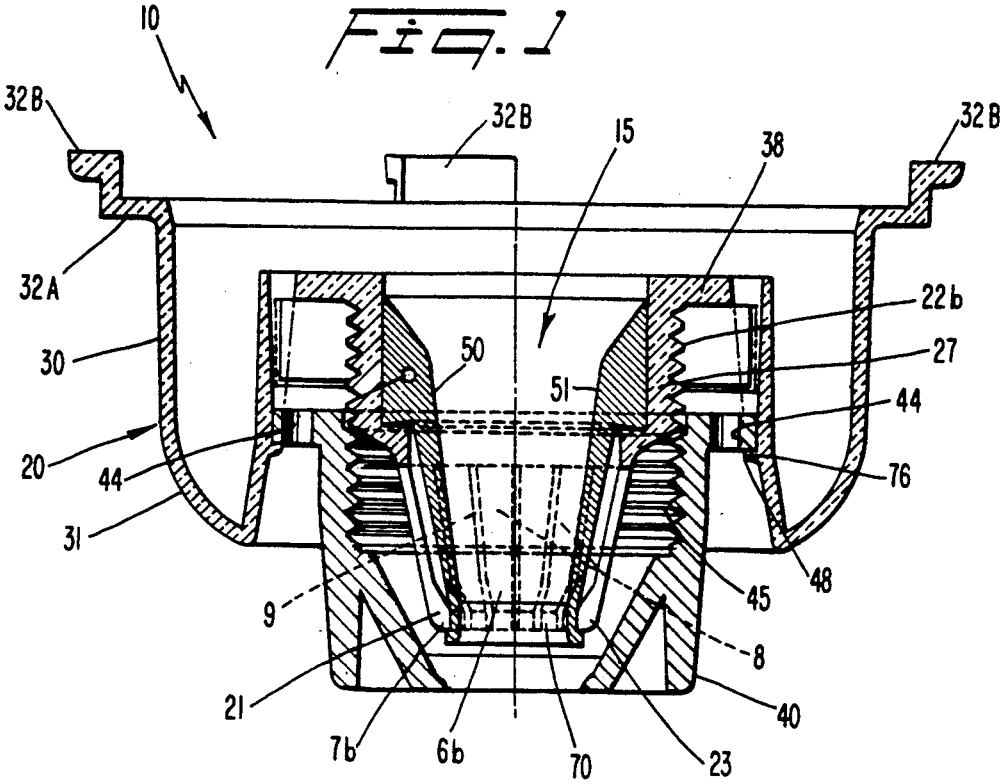
FIG. 1 is a sectional view of an adjustable dispenser nozzle according to the present invention in a fully open position.

FIG. 1 illustrates a novel adjustable nozzle 10 for such a towel dispenser. The dispenser nozzle 10 includes a base 20 having a conical portion 21 therein. The conical portion 21 defines a channel 15 through which towels (not shown) are pulled as they are dispensed. Additionally, the conical portion 21 has a narrow end 23 defining an aperture **6*b*. The towels exit the dispenser nozzle 10 through the channel 15 and the aperture 6*b***.

In a preferred embodiment, the conical portion 21 of the base 20 includes a plurality of extensions 8 that are defined and separated by substantially parallel slits 9.

These slits 9 impart an elastic characteristic to the conical portion 21. Furthermore, the conical portion 21 has a bottom edge 7*b* upon which the towels may be torn as they are dispensed from the dispenser nozzle 10.

The base 20 further includes an outer wall 30 for engaging the towel dispenser. The outer wall 30 includes a curved bottom 31 at one edge thereof. In addition, the outer wall 30 includes a rim 32A from which extend a plurality of tabs 32B for securing the base 20 to the towel dispenser. The rim 32A extends perpendicularly from the outer wall 30, and the tabs 32B are parallel to and extend outwardly from the rim 32A.

Figure 3:
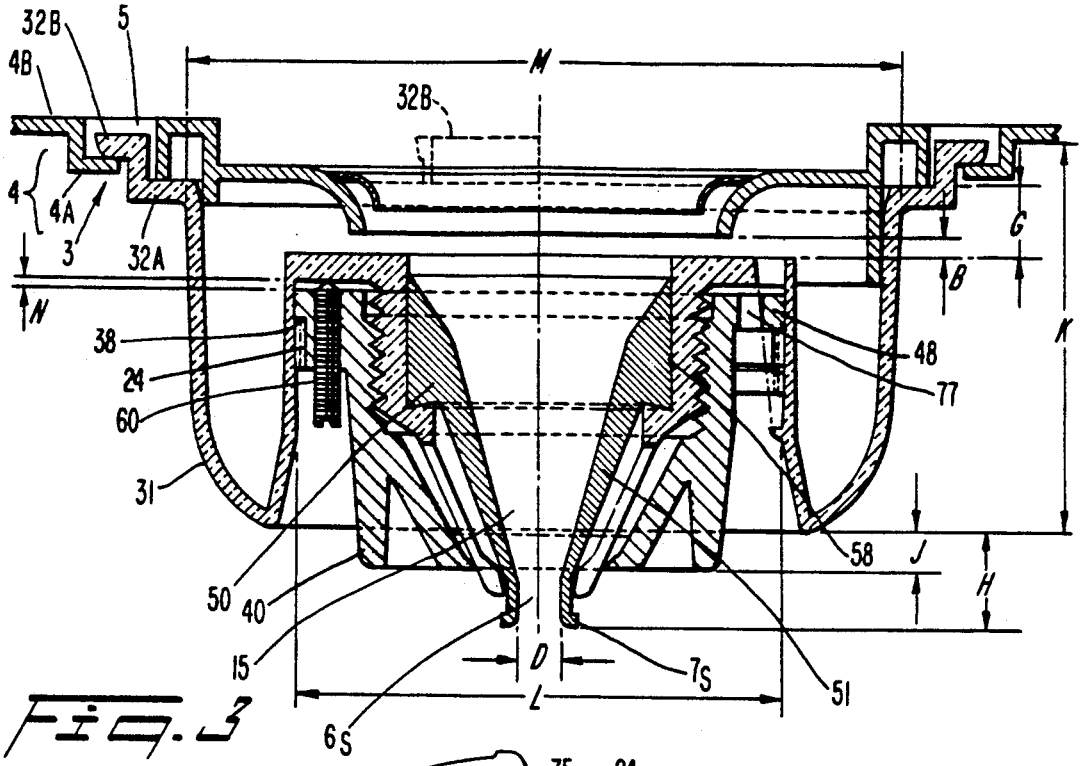
FIG. 3 is a sectional view of an adjustable dispenser nozzle according to the present invention in a fully narrowed position.

Turning attention to FIG. 3, the towel dispenser includes an outer wall 3 having a surface 4. The surface 4 includes a plurality of platforms 4A. The platforms 4A engage with the tabs 32B of the nozzle 10. When the dispenser nozzle 10 is attached to the towel dispenser, the rim 32A remains outside of the towel dispenser. The tabs 32B of the outer wall 30 provide a contact between the towel dispenser and the dispenser nozzle 10.

The curved bottom 31 of the base 20 is used as a gripping surface when replacing the dispenser nozzle 10. The dispenser nozzle 10 may be replaced by rotating the nozzle 10 so that the tabs 32B are free from the platforms 4A, and then pulling the dispenser nozzle 10 in a direction away from the towel dispenser.

The base 20 of the dispenser nozzle 10 may be comprised of an elastomeric material. In a preferred embodiment the material is a hard rubber known as ABS. However, instead of ABS, the base may be made from another material having a similar quality and characteristic. Due to the combination of the plurality of slits 9, the extensions 8 and the elasticity provided by the ABS, narrowing and expanding the exit aperture 6*b* of the base 20 is enabled.

The base 20 includes an interior wall 27 (see FIG. 2) having an exterior surface 22*b* and an interior surface 22*a*. The exterior surface 22*b* of the base 20 is threaded so as to receive a fixture, such as a collar 40 or a nut. The collar 40 includes a reciprocatingly threaded interior wall 45. Thus, the collar 40 may be threaded onto the threaded exterior surface 22*b* of the base 20 in a manner similar to attaching a nut to a bolt.

The collar 40 further includes a conical projection 41. The conical projection 41 protrudes inwardly toward the channel 15. The conical projection 41 also includes a bottom edge 7*f* having an aperture 6*f* therein, through which the towels pass as they are dispensed from the dispenser nozzle 10. When the extensions 8 of the base 20 do not protrude beyond the bottom edge 7*f* of the conical projection 41, the bottom edge 7*b* of the base 20 provides a suitable surface upon which the towels may be torn as they are dispensed.

The extensions 8 of the base 20 are located within the conical projection 41 of the collar 40. Furthermore, the exit aperture 6*f* the collar 40 is concentric with the exit aperture 6*b* of the base 20. Thus, the exit aperture 6*f* of the collar 40 together with the exit aperture 6*b* of the base 20, combine to form an exit aperture 70 of the dispenser nozzle 10. In addition, the conical projection 41 of the collar 40, together with the conical portion 21 of the base 20 define the channel 15 through which the towels pass as they are dispensed.

The collar 40 further includes a shoulder 48 (FIG. 1) adjacent the threaded interior wall 45 of the collar 40. In addition, the base 20 includes a corresponding shoulder 38 adjacent the threaded exterior surface 22*b* of the interior wall 27. The shoulder 38 of the base 20 extends in a perpendicular direction away from the threaded exterior surface 22*b*, and is parallel to the shoulder 48 of the collar 40. When the collar 40 is completely threaded onto the exterior wall 22*b* of the base 20, there is a distance N between the shoulder 38 of the base 20 and the shoulder 48 of the collar 40.

In a preferred embodiment (shown in FIGS. 1 and 2), the shoulder 48 of the collar 40 includes a plurality of apertures 44 extending therethrough. Additionally, the shoulder 38 of the base 20 includes a plurality of similar apertures 24 extending therethrough. See FIG. 4. Both the apertures 24 of the shoulder 38 and the apertures 44 of the shoulder 48 are adapted to receive a locking means, such as a set screw 60. Thus, when the collar 40 has been threaded onto the base 20 to the extent necessary to achieve a desired width of the exit aperture 70, the apertures 24 and 44 are aligned and the set screw 60 may be inserted through the respective apertures 24 and 44, to maintain the exit aperture 70 at the desired width.

Figure 4:
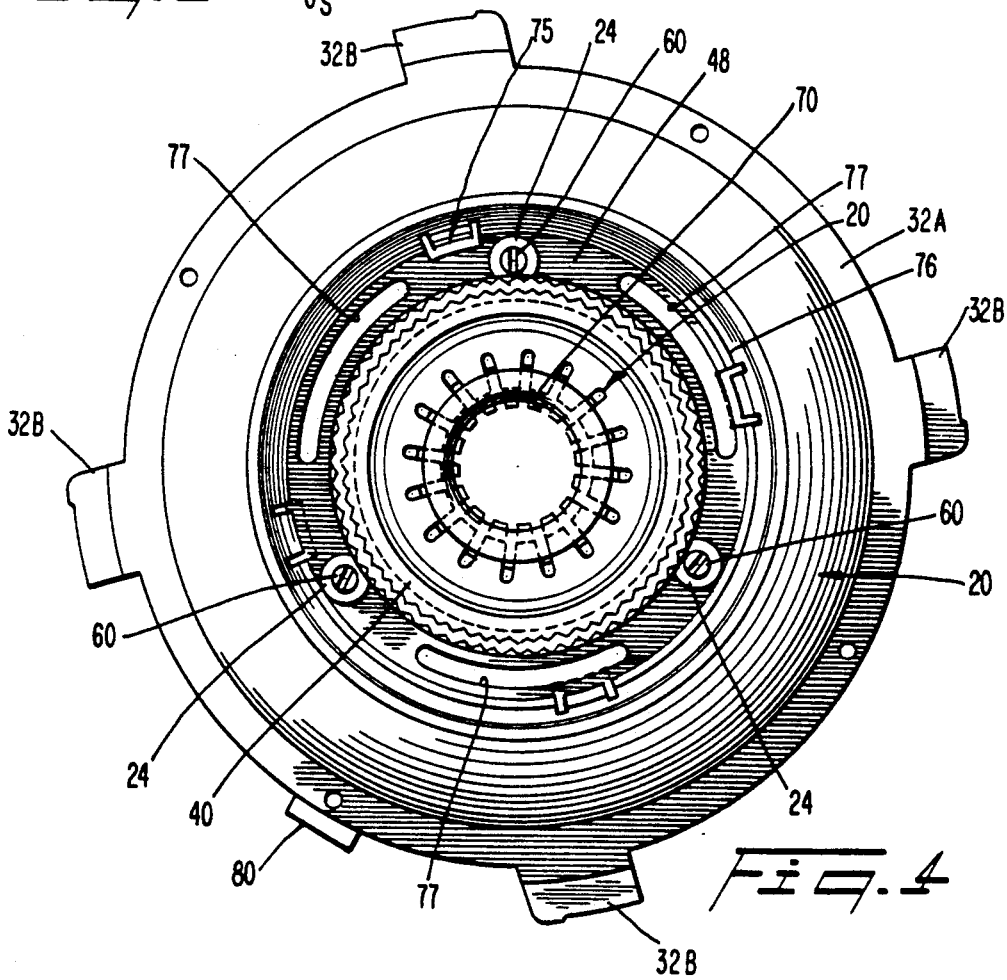
FIG. 4 is a top view of an adjustable dispenser nozzle according to the present invention.

The collar 40 further includes a plurality of teeth (not shown) comprised of a flexible material. The teeth extend perpendicularly from the shoulder 48 of the collar 40 toward the outer wall 30 of the base 20. Turning attention to FIG. 4, the dispenser nozzle 10 further includes a plurality of slotted openings 77. The slotted openings 77 act as a spring mechanism to the teeth of the collar 40, thus allowing the teeth to flex inward toward the channel 15 as the collar 40 is adjusted.

The collar 40 may be comprised of an acetal material, providing the collar 40 with a semi-rigid characteristic. Preferably, the collar 40 is made from a material that is more rigid than the material from which the base 20 is made. However, instead of acetal, the collar may be made from another material of similar quality and character. Thus, due to the nature of the material, as the exit aperture 70 of the dispenser nozzle 10 is narrowed or expanded, the diameter C of the aperture 6*f* of the collar 40 remains relatively constant.

In a preferred embodiment, the dispenser nozzle 10 further includes a sleeve 50. See FIG. 3. The sleeve 50 includes a head 58, which rests flush against the interior surface 22*a* of the base 20. The sleeve 50 further includes a conical portion 51 having a smooth tapered surface, which lines the interior part of the channel 15. The conical portion 51 of the sleeve 50 extends along the length of the channel 15. Thus, when the sleeve 50 is mounted within the dispenser nozzle 10, the sleeve defines the channel 15 through which towels pass as they exit the towel dispenser. The conical portion 51 of the sleeve 50 is concentric with the extensions 8 of the base 20, the conical projection 41 of the collar 40, and the exit aperture 70.

Furthermore, the sleeve 50 includes an exit aperture 6*s* which limits the exit aperture 70 as the sleeve protrudes beyond the bottom edge 7*f* of the collar 40. This position is attained when the collar 40 is fully threaded onto the base 20. The sleeve 50 also includes a bottom edge 7*s*, upon which the towels may be torn as they exit the dispenser nozzle 10.

In a preferred embodiment, the sleeve 50 may be comprised of a thermoset rubber material, such as polyurethane. However, instead of polyurethane, the sleeve 50 may be made from another material having suitable and or similar quality. The material of the sleeve 50 enables it to expand or contract to accommodate adjustments made to the dispenser nozzle 10.

Figure 2:
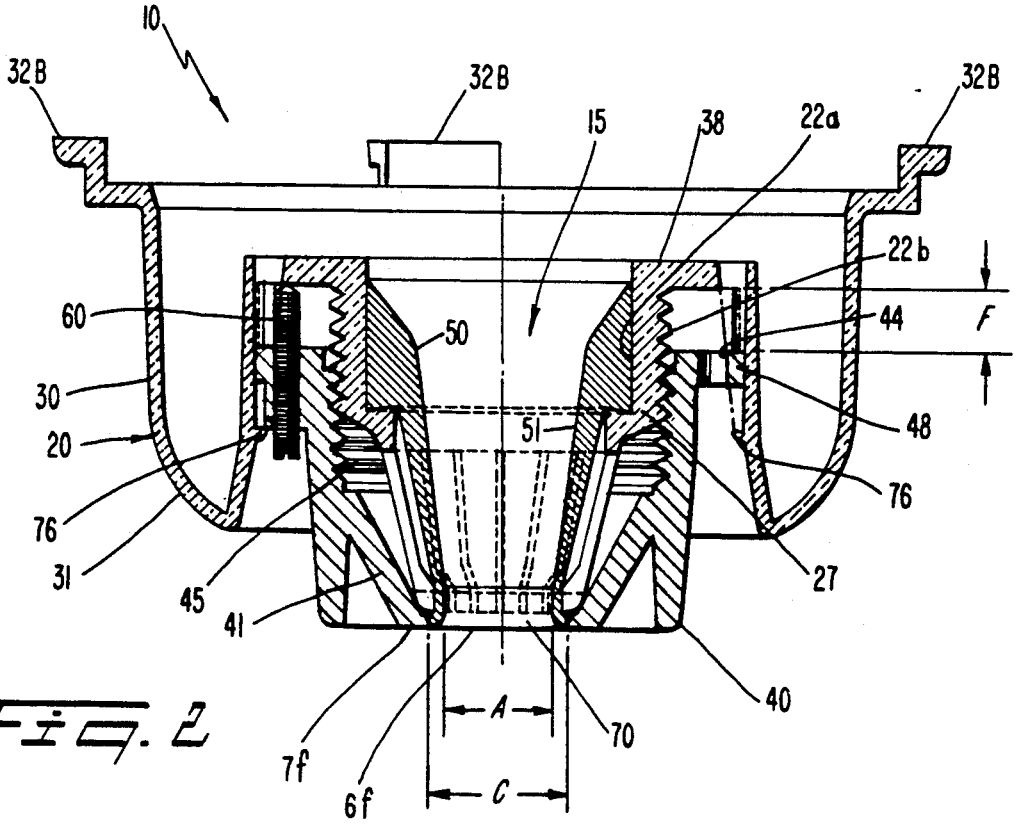
FIG. 2 is a sectional view of an adjustable dispenser nozzle according to the present invention in a thread-start position.

FIGS. 2 and 3 respectively illustrate the adjustable dispenser nozzle 10 in the "Thread-Start Position" and the "Fully Narrowed Position". In FIG. 2, the collar 40 is in a fully open position. FIG. 3 illustrates the dispenser nozzle 10 as the collar 40 is fully threaded onto the base 20, such that the shoulder 38 of the base 20 is within small distance "N" of the shoulder 48 of the collar 40.

When the collar 40 is fully threaded onto the base 20, the bottom edges *7f*, *7b* and *7s* of the collar 40, the base 20, and the sleeve 50, respectively, extend beyond the curved-bottom 31 of the base 20. When the collar 40 is completely threaded onto the base 20, a maximum distance, defined as H, between the curved bottom 31 of the base 20 and primary exit aperture 70 is achieved.

FIG. 4 illustrates the adjustable dispenser from a top view. The dispenser apparatus comprises a plurality of platforms 75 to retain the collar 40 adjacent the base 20. In addition, the platforms 75 assist in aligning the apertures 44 of the collar 40 with the apertures 24 of the base 20. These platforms are shown maintaining the collar 40 within the dispenser apparatus when the dispenser nozzle 10 is in a fully-open position. The platforms 75 ensure that the collar 40 is not removed from the towel dispenser.

The base 20 further includes a plurality of notches 76 for the collar 40 to engage as it is further threaded onto the base 20. The notches 76 provide a secure yet flexible attachment of the collar 40 to the dispenser nozzle 10. In addition, the towel dispenser further includes a lock 80 for securing the nozzle 10 to the towel dispenser.

In a preferred embodiment, the dispenser nozzle 10 includes four platforms 75 and twelve positioning notches 76. However, the exact number of platforms 75 and notches 76 are not limiting. The dispenser nozzle 10 may include varying numbers of notches 76 and platforms 75 as long as they provide a similar or suitable function to the dispenser nozzle 10.

The towel dispenser 413 further includes an opening through which the towels exit the towel dispenser 1 and enter the dispenser nozzle 10. The distance between the opening 2 of the towel dispenser 1 and the nozzle 10 is defined as B, as shown in FIG. 3.

For purposes of completeness, specific dimensions of a preferred embodiment are set forth below. The following is a chart of the dimensions of the dispenser nozzle 10 in a Thread Start Position:

| Item | Dimension (inches) |
|---|---|
| Diameter A | 0.600 |
| Distance F | 0.400 |
| Distance L | 2.908 |
| Distance M | 4.260 |
| Radius R | 1.00 |

The following is a chart of the varying dimensions of the dispenser nozzle 10 in a Fully Closed Position:

| Item | Dimension (inches) |
|---|---|
| Diameter D | 0.282 |
| Distance B | 0.081 |
| Distance G | 0.406 |
| Distance H | 0.576 |
| Distance J | 0.227 |
| Distance K | 2.321 |
| Distance L | 2.908 |
| Distance M | 4.260 |
| Distance N | 0.047 |

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed:

1. A method of adjusting an exit aperture of a nozzle for a towel dispenser, wherein the nozzle includes a threaded collar and a threaded base having a plurality of notches on it, comprising the steps of threading said collar onto said base;

changing a size of the exit aperture by changing a position of the collar with respect to the base; and engaging said collar with said notches.

2. The method of claim 1, wherein the position of the collar is changed by rotating the collar with respect to the base.

3. The method of claim 1, wherein the exit aperture of the nozzle, through which towels are dispensed, is formed in the base.

4. The method of claim 1, further comprising the step of providing a sleeve within the base so as to line the exit aperture.

5. The method of claim 1, wherein a portion of the base adjacent the exit aperture includes axially extending slits which enable the exit aperture to be contracted, and the changing step includes contacting the axially extending slits with a conical surface of the collar.

6. The method of claim 1, further comprising the step of dispensing the towels through an internal channel of the nozzle.

7. A method of adjusting an exit aperture of a nozzle for a towel dispenser, wherein the nozzle includes a threaded collar and a threaded base, comprising the steps of:

threading said collar onto said base;

changing a size of the exit aperture by changing a position of the collar with respect to the base; and securing the collar to the base by inserting a securing means through apertures in said collar and base.

8. A dispensing nozzle for use with a towel dispenser, comprising:

a base having a channel through which towels pass as they exit the dispenser, said base being attachable to said towel dispenser;

said channel having an exit aperture adjustable in size;

a fixture adjustably mounted to an outer surface of said base adjacent said channel in any of a plurality of usable positions;

means on said dispensing nozzle for defining said plurality of usable positions;

whereby the position of the fixture with respect to the exit aperture determines the size of the exit aperture.

9. The nozzle of claim 8, further comprising matching threaded surfaces on said base and said fixture so that the fixture may be threaded onto said base.

10. The nozzle of claim 8, further comprising a sleeve portion mounted within said base so as to line said channel.

11. The nozzle of claim 8, further comprising a flange extending from said base adjacent an entrance end of said channel.

12. The nozzle of claim 11, further comprising a horizontal shoulder emanating from a first end of said fixture.

13. The dispensing nozzle for use with a towel dispenser, comprising:

a base having a channel through which towels pass as they exit the dispenser, said base being attachable to said towel dispenser;

said channel having an exit aperture adjustable in size;

a fixture adjustably mounted to an outer surface of said base adjacent said channel, whereby a position of the fixture with respect to the exit aperture determines the size of the exit aperture;

a flange extending from said base adjacent an entrance end of said channel;

a horizontal shoulder emanating from a first end of said fixture; and a plurality of apertures in said flange and said shoulder.

14. The nozzle of claim 13, further comprising securing means that fit through said apertures so as to lock said fixture to said base.

15. The nozzle of claim 13, wherein said base is comprised of an elastomeric material.

16. The nozzle of claim 13, wherein said fixture is comprised of a resinous material.

17. The dispensing nozzle for use with a towel dispenser, comprising:

a base having a channel through which towels pass as they exit the dispenser, said base being attachable to said towel dispenser;

said channel having an exit aperture adjustable in size;

a fixture adjustably mounted to an outer surface of said base adjacent said channel;

whereby a position of the fixture with respect to the exit aperture determines the size of the exit aperture; and a sleeve portion mounted within said base so as to line said channel;

wherein said sleeve is comprised of polyurethane.

18. The nozzle of claim 17, wherein said base is releasably attachable to said paper towel dispenser.

19. The nozzle of claim 17, wherein the base is comprised of a first material and the fixture is comprised of a second material that is less flexible than said first material.

20. The dispensing nozzle for use with a towel dispenser, comprising:

a base having a channel through which towels pass as they exit the dispenser;

said base having an inwardly facing surface;

means for releasably securing said base to said towel dispenser;

said channel having an exit aperture adjustable in size;

means adjustably mounted to an outwardly facing surface of said base adjacent said channel for controlling the size of the exit aperture; and a plurality of adjusting notches along said inwardly facing surface of said base for said controlling means to engage.

21. The nozzle of claim 20, further comprising a sleeve for lining the channel of said base.

22. The nozzle of claim 20, further comprising matching threads on said base and said controlling means for enabling the controlling means to be threaded onto said base.

23. The nozzle of claim 20, wherein the base is comprised of a first material and said controlling means is comprised of a second material that is less flexible than said first material.

24. The nozzle of claim 20, wherein said base is comprised of an elastomeric material for enabling said base to contract.

25. The nozzle of claim 21, wherein said sleeve is comprised of polyurethane for contracting said exit aperture of said nozzle.

26. A towel dispenser, comprising:

a floor for supporting paper towels; and a dispensing nozzle, said dispensing nozzle includes a base having a channel through which towels pass as they exit the dispenser, said base being attachable to said towel dispenser floor, said channel having an exit aperture adjustable in size, and a fixture adjustably mounted to an outer surface of said base adjacent said channel, means on said dispensing nozzle for defining a plurality of usable positions, whereby a position of the fixture with respect to the exit aperture determines the size of the exit aperture.

27. The dispenser of claim 26, further comprising matching threaded surfaces on said base and said fixture so that the fixture may be threaded onto said base.

28. The dispenser of claim 26, further comprising a sleeve portion mounted within said base so as to line said channel.

29. A dispensing nozzle for use with a towel dispenser, comprising:

a base, attachable to said towel dispenser, and having an inner portion defining a channel through which towels pass as they exit the dispenser;

said base further including an outer portion concentric with said inner portion;

said channel having an exit aperture adjustable in size;

a fixture adjustably mounted between said inner portion and said outer portion; means on said dispensing nozzle for defining a plurality of usable positions;

whereby a position of the fixture with respect to the exit aperture determines the size of the exit aperture.

30. The dispensing nozzle of claim 29, wherein said fixture engages said inner portion and said outer portion.

31. The dispensing nozzle of claim 29, wherein said fixture is threadably engaged with said inner portion.

32. The dispensing nozzle of claim 29, wherein said fixture engages said outer portion with notches.

33. The dispensing nozzle of claim 31, wherein said fixture engages said outer portion with notches.

34. A dispensing nozzle for use with a towel dispenser, comprising:

a base having a channel through which towels pass as they exit the dispenser, said base being attachable to said towel dispenser;

said channel having an exit aperture adjustably in size;

a fixture adjustably mounted to an outer surface of said base adjacent said channel, whereby a position of the fixture with respect to the exit aperture determines the size of the exit aperture; and notch means on said dispensing nozzle for enabling engagement between said base and said fixture at selected positions.

35. The nozzle of claim 34, wherein said fixture is threadably engaged to the outer surface of said base.

36. The nozzle of claim 34, wherein said notch means are integral with said base.

37. The nozzle of claim 35, wherein said notch means are integral with said base.

38. The nozzle of claim 34, further comprising a sleeve extending through said channel.

39. A dispensing nozzle for use with a towel dispenser, comprising:

a base having a channel through which towels pass as they exit the dispenser, said base being attachable to said towel dispenser;

said channel having an exit aperture adjustable in size;

a fixture adjustably mounted to an outer surface of said base adjacent said channel, whereby a position of the fixture with respect to the exit aperture determines the size of the exit aperture; and a sleeve arranged concentrically inside said channel;

said base portion forming said channel includes longitudinally extending slits to facilitate adjustment of the aperture size; and said sleeve includes longitudinally extending slits so as to enable said sleeve to accommodate adjustments in the size of said channel.

40. The nozzle of claim 39, wherein said fixture is threadably engaged to the outer surface of said base.

41. The nozzle of claim 39, further comprising notch means on said dispensing nozzle for enabling engagement between said base and said fixture at selected positions.

* * * * *